US010926854B2

(12) United States Patent
Mizutani

(10) Patent No.: US 10,926,854 B2
(45) Date of Patent: Feb. 23, 2021

(54) STEERING DEVICE AND OUTBOARD MOTOR UNIT

(71) Applicant: YAMAHA HATSUDOKI KABUSHIKI KAISHA, Iwata (JP)

(72) Inventor: Makoto Mizutani, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 0 days.

(21) Appl. No.: 16/495,143

(22) PCT Filed: Mar. 19, 2018

(86) PCT No.: PCT/JP2018/010753
§ 371 (c)(1),
(2) Date: Sep. 18, 2019

(87) PCT Pub. No.: WO2018/211809
PCT Pub. Date: Nov. 22, 2018

(65) Prior Publication Data

US 2020/0017182 A1 Jan. 16, 2020

(30) Foreign Application Priority Data

May 18, 2017 (JP) ..... JP2017-098730

(51) Int. Cl.
*B63H 20/12* (2006.01)
*B63H 20/00* (2006.01)
(Continued)

(52) U.S. Cl.
CPC ..... *B63H 20/12* (2013.01); *B63H 20/00* (2013.01); *B63H 20/08* (2013.01); *B63H 25/00* (2013.01); *B63H 25/14* (2013.01)

(58) Field of Classification Search
CPC ..... B63H 20/00; B63H 20/08; B63H 20/12; B63H 25/00; B63H 25/10; B63H 25/14;
(Continued)

(56) References Cited

U.S. PATENT DOCUMENTS 6,715,438 B1 * 4/2004 Hundertmark ..... B63H 20/12 114/144 R
7,325,507 B1 * 2/2008 Hundertmark ..... B63H 20/12 114/150
(Continued)

FOREIGN PATENT DOCUMENTS

JP 03-592 A 1/1991
JP 08-276896 A 10/1996
(Continued)

OTHER PUBLICATIONS

Official Communication issued in International Patent Application No. PCT/JP2018/010753, dated Jun. 12, 2018.

*Primary Examiner* — Lars A Olson
(74) *Attorney, Agent, or Firm* — Keating and Bennett, LLP

(57) ABSTRACT

A steering device for an outboard motor is rotatably supported on a hull of a boat about a steering axis. The steering device includes a tiller handle, an actuator, and a linkage. The tiller handle is attached to the outboard motor. The actuator rotates the tiller handle about the steering axis. The link linkage is movably disposed between a connection position and a blocking position. The linkage transmits the driving force from the actuator to the tiller handle at the connection position. The linkage shuts off the transmission of the driving force from the actuator to the tiller handle at the blocking position.

16 Claims, 15 Drawing Sheets

(51) Int. Cl.
*B63H 20/08* (2006.01)
*B63H 25/00* (2006.01)
*B63H 25/14* (2006.01)

(58) Field of Classification Search
CPC ..... B63H 25/22; B63H 25/34; B63H 5/00; B63H 5/12; B63H 21/00; B63H 21/265
USPC ..... 114/144 R, 150; 441/61 R, 61 S; 440/61 R, 61 S
See application file for complete search history.

(56) References Cited

U.S. PATENT DOCUMENTS

| | | | | |
|---|---|---|---|---|
| 7,681,513 | B1 * | 3/2010 | Hundertmark ..... | B63H 20/12 114/144 R |
| 2011/0117798 | A1 | 5/2011 | Harada et al. | |

FOREIGN PATENT DOCUMENTS

| | | | |
|---|---|---|---|
| JP | 2006-199064 | A | 8/2006 |
| JP | 2006-306174 | A | 11/2006 |
| JP | 2011-111127 | A | 6/2011 |

* cited by examiner

STEERING DEVICE AND OUTBOARD MOTOR UNIT

BACKGROUND OF THE INVENTION

1. Field of the Invention

The present invention relates to a steering device and an outboard motor unit.

2. Description of the Related Art

Conventionally, a steering device that steers an outboard motor by an actuator is known. For example, the steering device of Japan Patent Laid-open Patent Publication No. 2006-199064 includes an operation unit, a detection unit, and an electric motor. The operation unit includes a hydraulic pump connected to the steering wheel. The detection unit includes a hydraulic damper mechanism and a stroke sensor. The hydraulic damper mechanism is displaced by hydraulic fluid from the hydraulic pump. The stroke sensor detects the displacement of the hydraulic damper. The signal from the stroke sensor is input to an ECU. The ECU detects the steering angle of the steering wheel by the signal from the stroke sensor. Then, the ECU steers the outboard motor by controlling the electric motor according to the steering angle.

In the steering device disclosed in Japan Patent Laid-open Patent Publication No. 2006-199064 described above, it is necessary to dispose an operation unit, a detection unit, an electric motor, and a communication line connecting these on the hull. However, some small boats do not have a steering wheel and are steered manually by a tiller handle. It is difficult to mount the above-described steering device on such a small boat. Alternatively, some small boats steer the outboard motor via wires connected to the steering wheel. Even in such a small boat, in order to mount the above-described steering device, it is necessary to replace the existing steering device, and thus the mounting is not easy.

In addition, even in the case of a boat equipped with a steering device, the operator may want to perform steering manually. In such a case, it may become difficult to perform the manual steering due to resistance from the steering device.

SUMMARY OF THE INVENTION

Preferred embodiments of the present invention provide steering devices for outboard motors, and outboard motor units that are easily mounted on a small boat and manually steered.

According to a preferred embodiment of the present invention, a steering device for an outboard motor supported by a hull so as to be rotatable about a steering axis includes a tiller handle, an actuator, and a linkage. The tiller handle is attached to the outboard motor. The actuator is configured to rotate the tiller handle about the steering axis. The linkage is movably disposed between a connection position and a blocking position. The linkage transmits the driving force from the actuator to the tiller handle at the connection position. The linkage shuts off the transmission of the driving force from the actuator to the tiller handle at the blocking position.

According to a preferred embodiment of the present invention, an outboard motor unit includes an outboard motor and the steering device described above.

According to a preferred embodiment of the present invention, the actuator is provided together with the tiller handle. The actuator steers the outboard motor by rotating the tiller handle. Therefore, the steering device is easily mounted on the small boat. Also, the linkage blocks transmission of the driving force from the actuator to the tiller handle at the blocking position. Therefore, when the operator manually steers the outboard motor with the tiller handle, by moving the linkage to the blocking position, steering is able to be performed with a light operating force.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
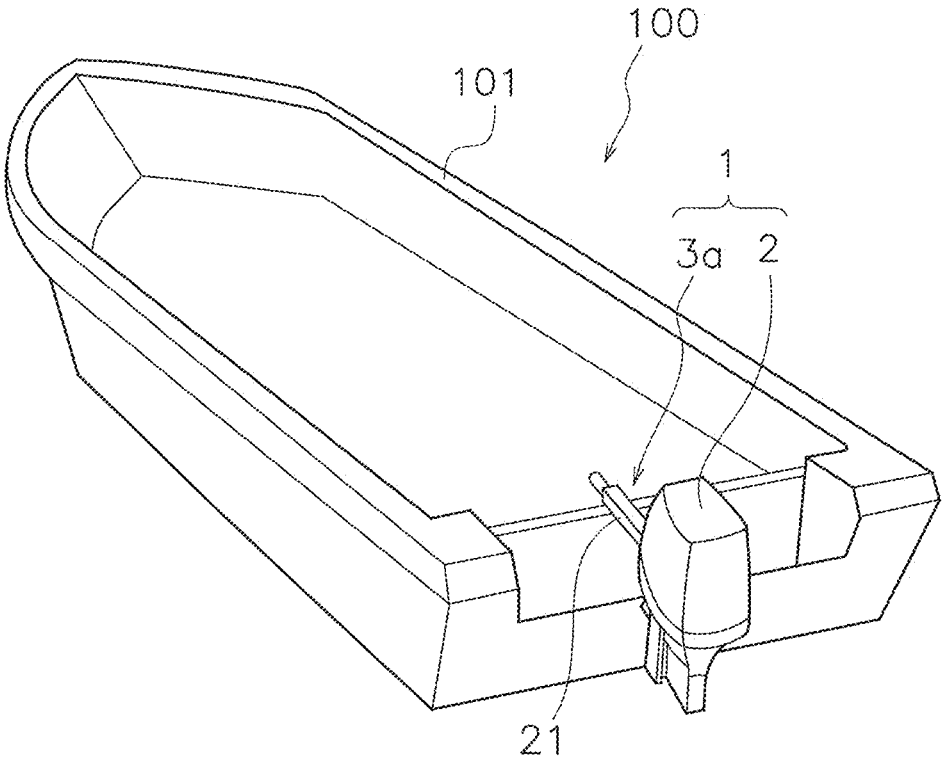
FIG. 1 is a perspective view showing a boat equipped with a steering device according to a first preferred embodiment of the present invention.

Hereinafter, preferred embodiments of the present invention will be described with reference to the drawings. FIG. 1 is a perspective view showing a boat 100. The boat 100 includes a hull 101 and an outboard motor unit 1. The outboard motor unit 1 is attached to the hull 101. The outboard motor unit 1 includes an outboard motor 2 and a steering device 3*a*.

The outboard motor 2 is attached to the stern of the hull 101. The outboard motor 2 generates a propulsive force that propels the hull 101. In the present preferred embodiment, the number of outboard motors 2 is one, but two or more outboard motors 2 may be mounted on the boat 100.

Figure 2:
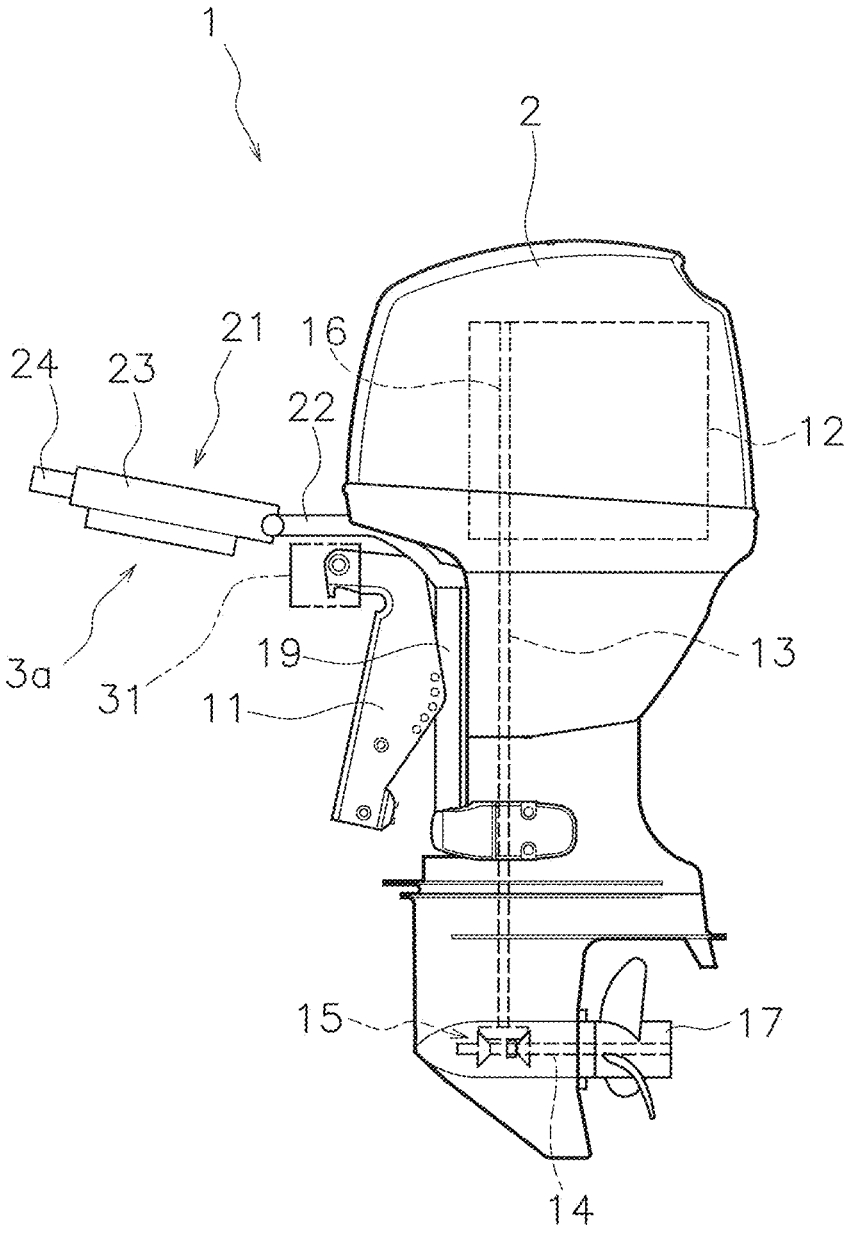
FIG. 2 is a side view of an outboard motor unit.

FIG. 2 is a side view of the outboard motor unit 1. The outboard motor 2 is attached to the hull 101 via a bracket 11.

The bracket 11 supports the outboard motor 2 rotatably around a steering shaft 19. The outboard motor 2 includes an engine 12, a drive shaft 13, a propeller shaft 14, and a shift mechanism 15, for example.

The engine 12 generates a propulsion force that propels the boat 100. The engine 12 includes a crankshaft 16. The crankshaft 16 preferably extends in the vertical direction. The drive shaft 13 is connected to the crankshaft 16. The drive shaft 13 preferably extends in the vertical direction. The propeller shaft 14 extends in the front-rear direction. The propeller shaft 14 is connected to the drive shaft 13 via the shift mechanism 15. The shift mechanism 15 switches the rotational direction of the power transmitted from the drive shaft 13 to the propeller shaft 14. The shift mechanism 15 includes, for example, a plurality of gears and a clutch that changes the meshing of the gears. A propeller 17 is connected to the propeller shaft 14.

The steering device 3*a* includes a tiller handle 21. The tiller handle 21 is attached to the outboard motor 2. The tiller handle 21 extends forward from the outboard motor 2. The tiller handle 21 includes an arm 22, a tiller main body 23, and a grip 24. The arm 22 is attached to the outboard motor 2. The tiller main body 23 is connected to the arm 22. The grip 24 is a portion held by the operator. The grip 24 is connected to the tiller main body 23 and provided at the tip of the tiller handle 21.

Figure 3:
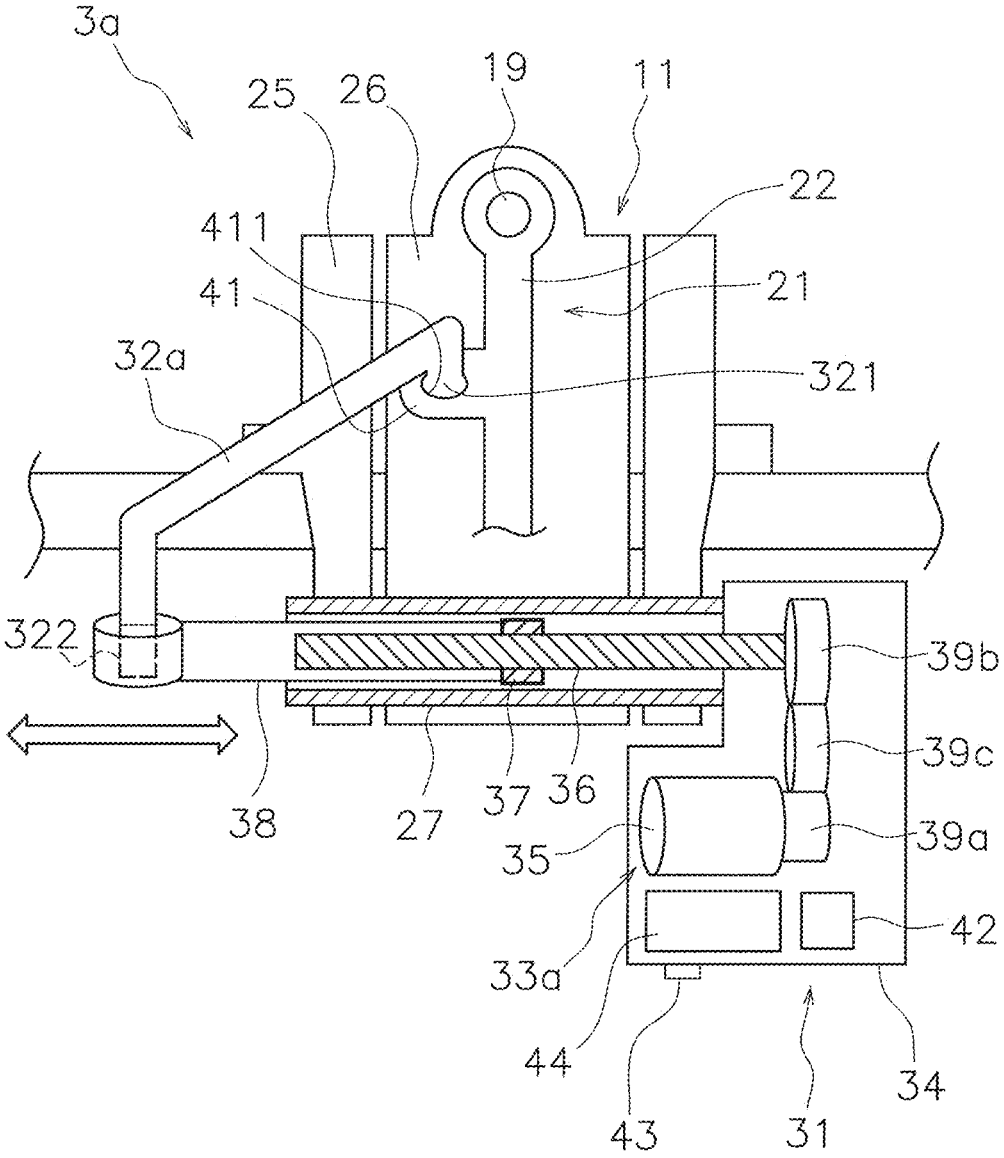
FIG. 3 is a top view showing a configuration of the steering device.

FIG. 3 is a top view showing the configuration of the steering device 3*a* according to the first preferred embodiment of the present invention. In FIG. 3, a portion of the steering device 3*a* is illustrated in cross section. As illustrated in FIG. 3, the bracket 11 includes a first bracket 25 and a second bracket 26. The first bracket 25 is fixed to the hull 101. The second bracket 26 is attached to the first bracket 25 via the tube 27. The tube 27 preferably extends in the width direction of the hull 101. The second bracket 26 is rotatably supported by the first bracket 25 about a central axis (tilt axis) of the tube 27. Thus, the outboard motor 2 is able to be tilted up and down about the tilt axis.

The steering device 3*a* includes an actuator unit 31 and a linkage 32*a*. The actuator unit 31 includes an actuator 33*a* and a housing 34. The actuator 33*a* rotates the tiller handle 21 about the steering shaft 19. The actuator 33*a* includes a motor 35, a screw 36, a movable member 37, and a piston rod 38.

The motor 35 is, for example, an electric motor. The screw 36 is, for example, a ball screw. The screw 36 is connected to the motor 35 via the gears 39*a*, 39*b*, 39*c*. The motor 35 and the gears 39*a*, 39*b*, 39*c* are accommodated in the housing 34. The movable member 37 is preferably a nut and is screwed onto the screw 36. The piston rod 38 is connected to the movable member 37. At least a portion of the screw 36, the movable member 37, and at least a portion of the piston rod 38 are disposed within the tube 27. The movable member 37 and the piston rod 38 are disposed movably with respect to the tube 27.

The rotation of the motor 35 is transmitted to the screw 36 via the gears 39*a*, 39*b*, 39*c*, and thus the screw 36 is rotated. When the movable member 37 moves in the central axial direction of the tube 27 due to the rotation of the screw 36, the piston rod 38 extends and retracts relative to the tube 27. Thus, the piston rod 38 moves to the left and right.

The linkage 32*a* connects the actuator 33*a* and the tiller handle 21. The linkage 32*a* connects the piston rod 38 and the arm 22 of the tiller handle 21. The linkage 32*a* is preferably a rod-shaped member, for example.

The linkage 32*a* is movably disposed between a connection position and a blocking position. More specifically, the linkage 32*a* is detachably connected to the arm 22. The linkage 32*a* includes a first end 321 and a second end 322. The arm 22 includes a connector 41 to which the first end 321 of the linkage 32*a* is connected. The connector 41 includes a hole 411. The linkage 32*a* is connected to the connector 41 by inserting the first end 321 into the hole 411. The second end 322 is rotatably connected to the tip of the piston rod 38.

The connector 41 is located rearward of the tip of the tiller handle 21. The connector 41 is located forward of the steering shaft 19. Therefore, the actuator 33*a* is connected to the tiller handle 21 at a position between the tip of the tiller handle 21 and the steering shaft 19.

When the first end 321 is connected to the connector 41, the linkage 32*a* is in the connection position. When the linkage 32*a* is located at the connection position, the piston rod 38 and the arm 22 are connected to each other. Therefore, when the linkage 32*a* is located at the connection position, the driving force of the actuator 33*a* is transmitted to the tiller handle 21. Therefore, in response to the movement of the piston rod 38, the tiller handle 21 rotates around the steering shaft 19, and along with that, the outboard motor 2 rotates left and right around the steering shaft 19.

Figure 4:
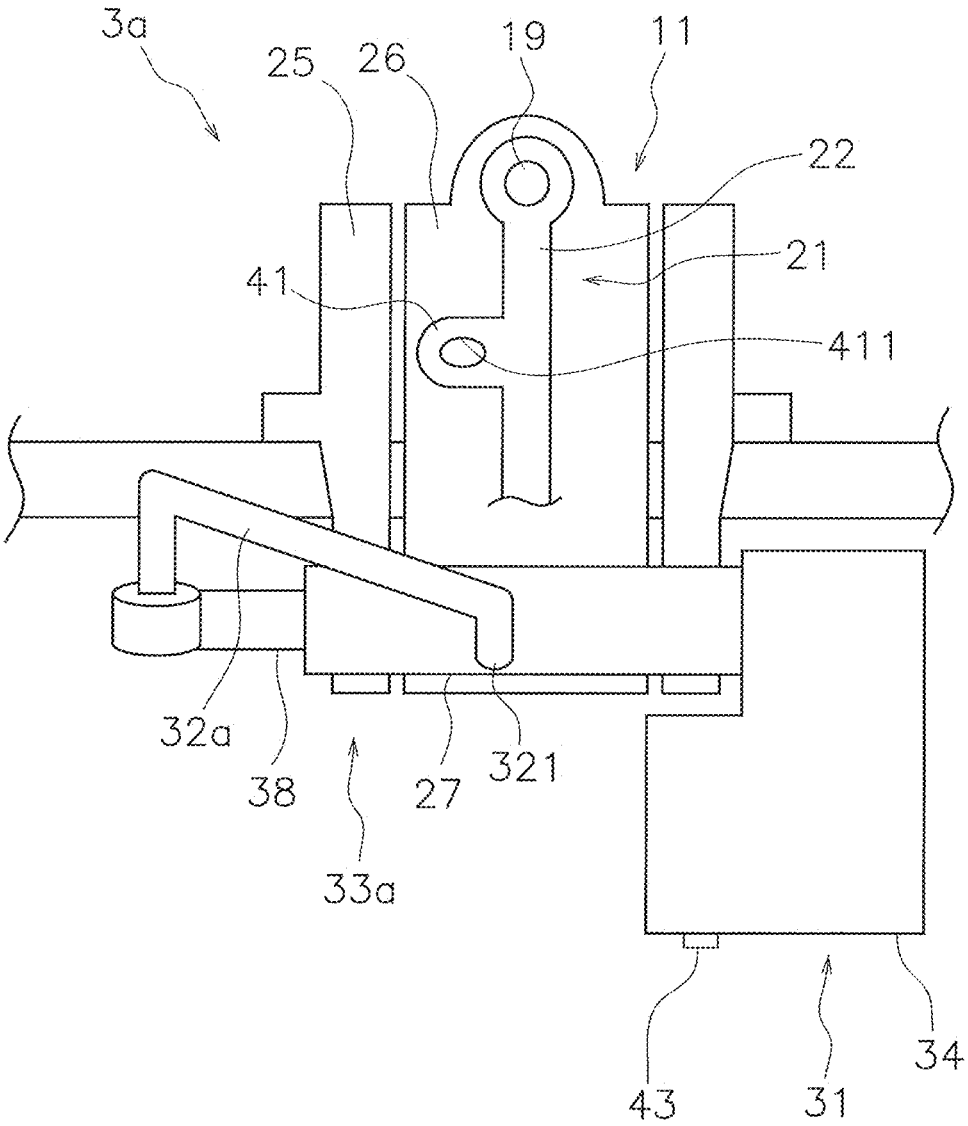
FIG. 4 is a top view showing a configuration of the steering device.

As illustrated in FIG. 4, when the first end 321 is removed from the connector 41, the linkage 32*a* is in the blocking position. When the linkage 32*a* is located at the blocking position, the connection between the piston rod 38 and the arm 22 is released. Therefore, when the linkage 32*a* is located at the blocking position, the transmission of the driving force from the actuator 33*a* to the tiller handle 21 is blocked.

As illustrated in FIG. 3, the steering device 3*a* includes an azimuth sensor 42, an operation switch 43, and a controller 44. The azimuth sensor 42 detects the actual heading of the hull 101. The azimuth sensor 42 outputs a detection signal indicating the actual heading of the hull 101. The operation switch 43 is attached to the housing 34. The operation switch 43 is operated by the operator to set the target azimuth of the hull 101.

The operation switch 43 is, for example, a dial switch. However, the operation switch 43 may be another switch such as a push button, for example. Alternatively, the operation switch 43 may be a software switch displayed on the touch screen. The operation switch 43 outputs an operation signal indicating an operation position of the operation switch 43.

The controller 44 is housed in the housing 34. The controller 44 includes a processor such as a CPU and a memory such as a RAM or a ROM, for example. The controller 44 stores programs and data to control the actuator 33*a*. The controller 44 receives a detection signal from the azimuth sensor 42. The controller 44 receives an operation signal from the operation switch 43. The controller 44 sets the target azimuth in response to the operation of the operation switch 43, and controls the steering device 3*a* such that the actual heading of the hull 101 matches the target azimuth.

Figure 5:
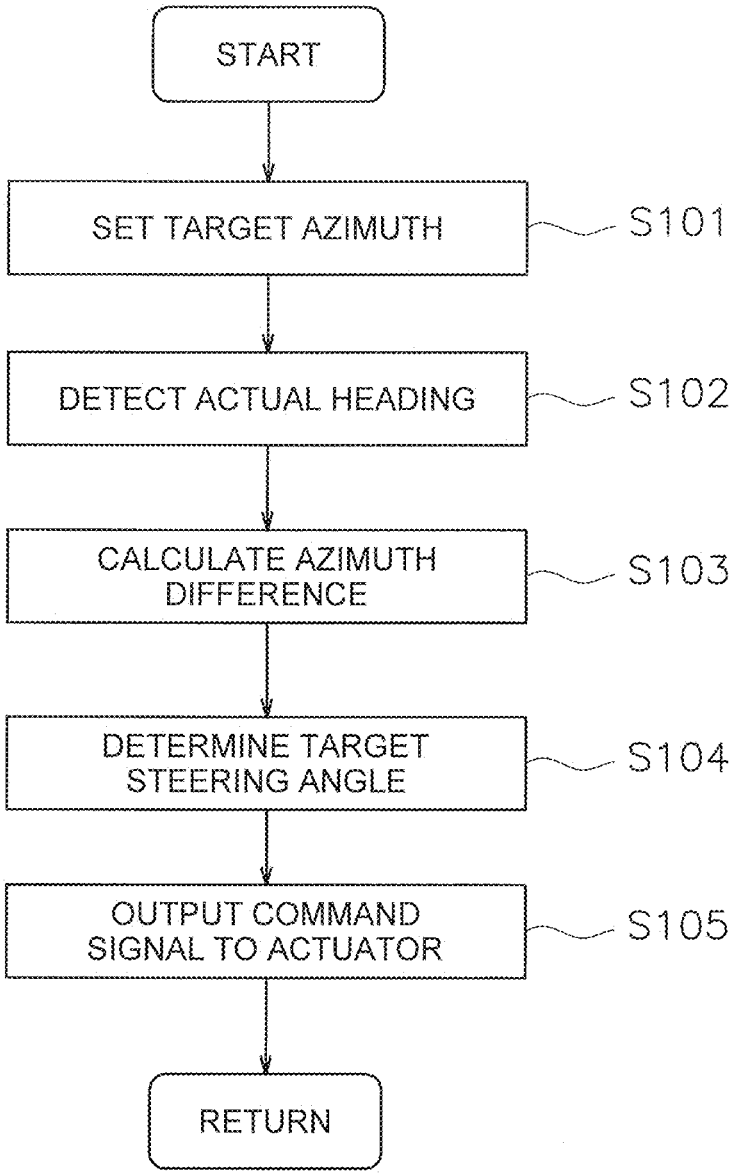
FIG. 5 is a flowchart showing a process for controlling the steering device.

FIG. 5 is a flowchart showing a process for controlling the steering device 3*a* which is executed by the controller 44. As illustrated in FIG. 5, in step S101, the controller 44 sets a target azimuth. The controller 44 sets the target azimuth based on the operation signal from the operation switch 43.

In step S102, the controller 44 detects an actual heading of the hull 101. The controller 44 detects the actual heading based on the detection signal from the azimuth sensor 42. In step S103, the controller 44 calculates an azimuth difference.

The controller 44 calculates the deviation angle of the actual heading from the target azimuth as the azimuth difference.

In step S104, the controller 44 determines a target steering angle. The controller 44 determines the target steering angle such that the azimuth difference is reduced. For example, the controller 44 stores data defining the relationship between the azimuth difference and the target steering angle, and determines the target steering angle from the azimuth difference by referring to the data.

In step S105, the controller 44 outputs a command signal to the actuator 33*a*. The controller 44 outputs a command signal corresponding to the target steering angle to the actuator 33*a*. Thus, the actuator 33*a* rotates the outboard motor 2 together with the tiller handle 21 about the steering shaft 19 so that the steering angle of the outboard motor 2 becomes the target steering angle.

In the steering device 3*a* according to the present preferred embodiment described above, the actuator 33*a* is provided together with the tiller handle 21. The actuator 33*a* steers the outboard motor 2 by rotating the tiller handle 21. Therefore, the steering device 3*a* is easily mounted on a small boat.

Further, the steering device 3*a* is easily provided by retrofitting the actuator unit 31 and the linkage 32*a* to the existing tiller handle 21.

The linkage 32*a* blocks transmission of the driving force from the actuator 33*a* to the tiller handle 21 at the blocking position. Therefore, when the operator manually steers the outboard motor 2 with the tiller handle 21, the linkage 32*a* may be moved to the blocking position to operate the tiller handle 21 without receiving resistance from the actuator 33*a*. Thus, the operator is able to steer with the tiller handle 21 with a light operating force.

In the steering device 3*a*, a portion of the actuator 33*a* is disposed in the tube 27. Therefore, the actuator 33*a* is prevented from interfering with the bracket at the time of tilting the outboard motor 2.

Figure 6:
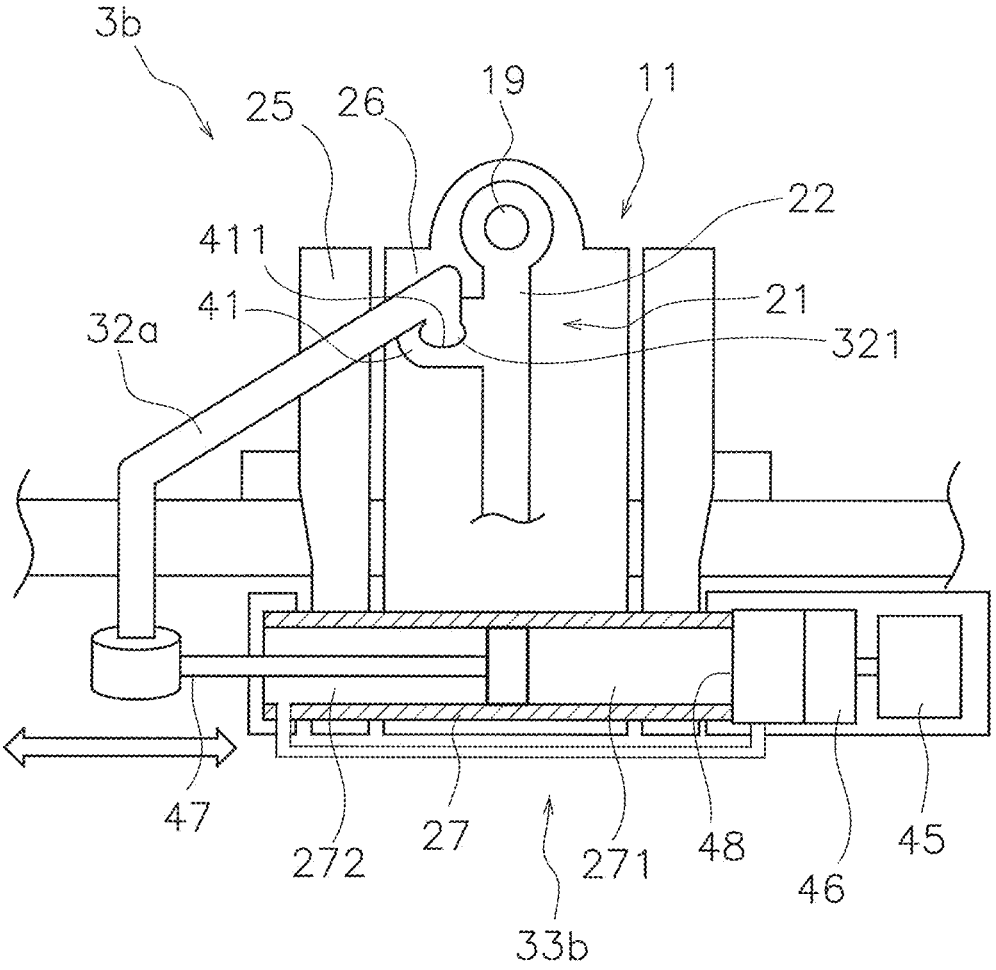
FIG. 6 is a top view showing a steering device according to a second preferred embodiment of the present invention.

In the steering device 3*a* according to the first preferred embodiment described above, the actuator 33*a* is preferably an electric actuator, but the steering device may include a hydraulic actuator, for example. FIG. 6 is a top view showing a steering device 3*b* according to the second preferred embodiment of the present invention.

As illustrated in FIG. 6, the steering device 3*b* according to the second preferred embodiment includes a hydraulic actuator 33*b*. The actuator 33*b* includes a motor 45, a hydraulic pump 46, a piston rod 47, and a control valve 48. The hydraulic pump 46 is connected to the motor 45. The hydraulic pump 46 is driven by the motor 45 to discharge the hydraulic fluid.

A portion of the piston rod 47 is disposed in the tube 27. The piston rod 47 divides the inside of the tube 27 into a first chamber 271 and a second chamber 272. The control valve 48 switches between supplying and discharging hydraulic fluid from the hydraulic pump 46 to the first chamber 271 and the second chamber 272. The control valve 48 and the motor 45 are controlled by a controller (not illustrated).

When the hydraulic fluid from the hydraulic pump 46 is supplied to the first chamber 271 and discharged from the second chamber 272, the piston rod 47 extends. When the hydraulic fluid from the hydraulic pump 46 is supplied to the second chamber 272 and discharged from the first chamber 271, the piston rod 47 retracts. Thus, the piston rod 47 extends and retracts due to the hydraulic pressure from the hydraulic pump 46 and moves left and right with respect to the tube 27. Thus, the outboard motor 2 is rotated leftward and rightward around the steering shaft 19 together with the tiller handle 21. Other configurations of the steering device 3*b* according to the second preferred embodiment are preferably the same or substantially the same as that of the steering device 3*a* according to the first preferred embodiment.

Figure 7:
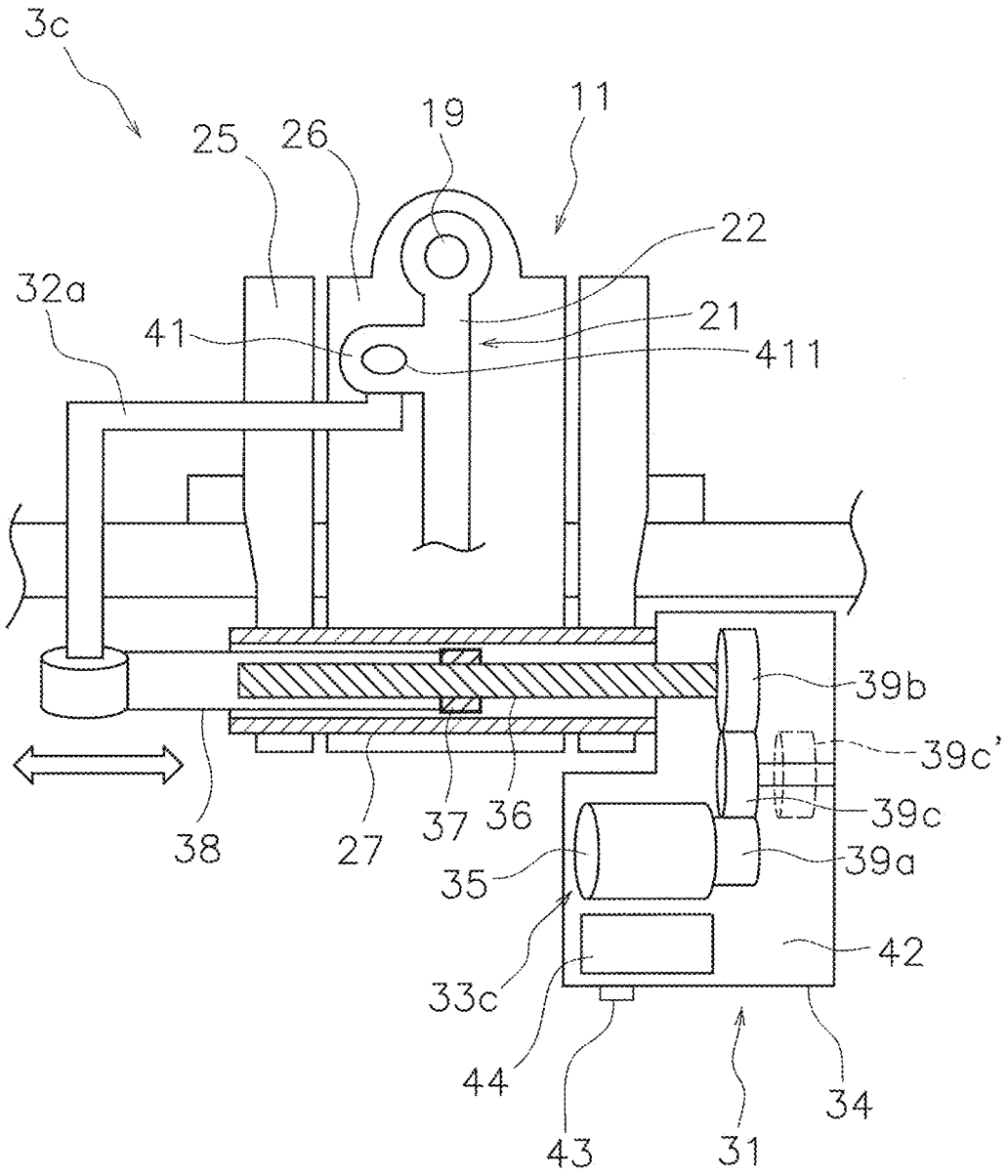
FIG. 7 is a top view of a steering device according to a third preferred embodiment of the present invention.

In the preferred embodiments described above, the linkage 32*a* is movable to the connection position and the blocking position. However, a member different from the linkage 32*a* may be movable to the connection position and the blocking position. FIG. 7 is a top view of a steering device 3*c* according to the third preferred embodiment of the present invention. As shown in FIG. 7, in the actuator 33*c* of the steering device 3*c* according to the third preferred embodiment, one of the plurality of gears 39*a*, 39*b*, 39*c* is movably disposed at the connection position and the blocking position.

Specifically, the plurality of gears 39*a*, 39*b*, 39*c* include an input gear 39*a*, an output gear 39*b*, and a link gear 39*c*. The input gear 39*a* is fixed to the output shaft of the motor 35. The output gear 39*b* is fixed to the screw 36. The link gear 39*c* is detachably connected to the actuator 33. That is, the link gear 39*c* is movably disposed between the connection position and the blocking position.

The link gear 39*c* meshes with the input gear 39*a* and the output gear 39*b* at the connection position. Therefore, the link gear 39*c* transmits the driving force from the actuator 33 to the tiller handle 21 by transmitting the rotation of the motor 35 to the screw 36 at the connection position. The link gear 39*c* is released from meshing between the input gear 39*a* and the output gear 39*b* at the blocking position (39*c*' in FIG. 7). Therefore, the link gear 39*c* blocks the transmission of the driving force from the actuator 33 to the tiller handle 21 at the blocking position. Other configurations of the steering device 3*c* according to the third preferred embodiment are preferably the same or substantially the same as that of the steering device 3*a* according to the first preferred embodiment.

In the steering device 3*c* according to the third preferred embodiment, when the link gear 39*c* is at the connection position, the rotation of the motor 35 is transmitted to the screw 36, and the piston rod 38 extends and retracts. Thus, the outboard motor 2 is rotated about the steering shaft 19 together with the tiller handle 21. In addition, when the operator manually steers the outboard motor 2 with the tiller handle 21, the link gear 39*c* may be moved to the blocking position to operate the tiller handle 21 without receiving resistance from the actuator 33*c*. Thus, the operator is able to perform steering with the tiller handle 21 with a light operating force.

Figure 8:
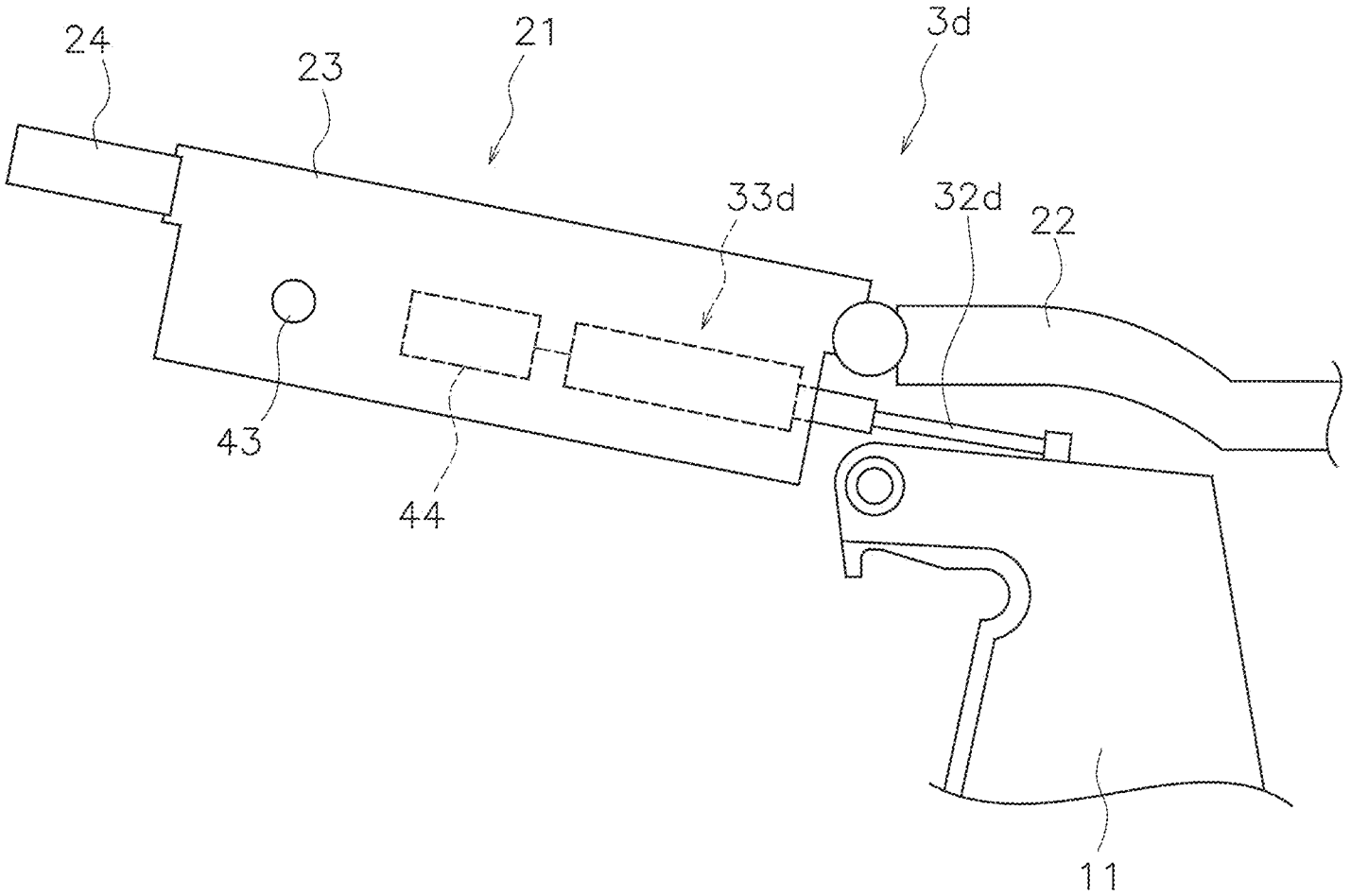
FIG. 8 is a side view of a steering device according to a fourth preferred embodiment of the present invention.
Figure 9:
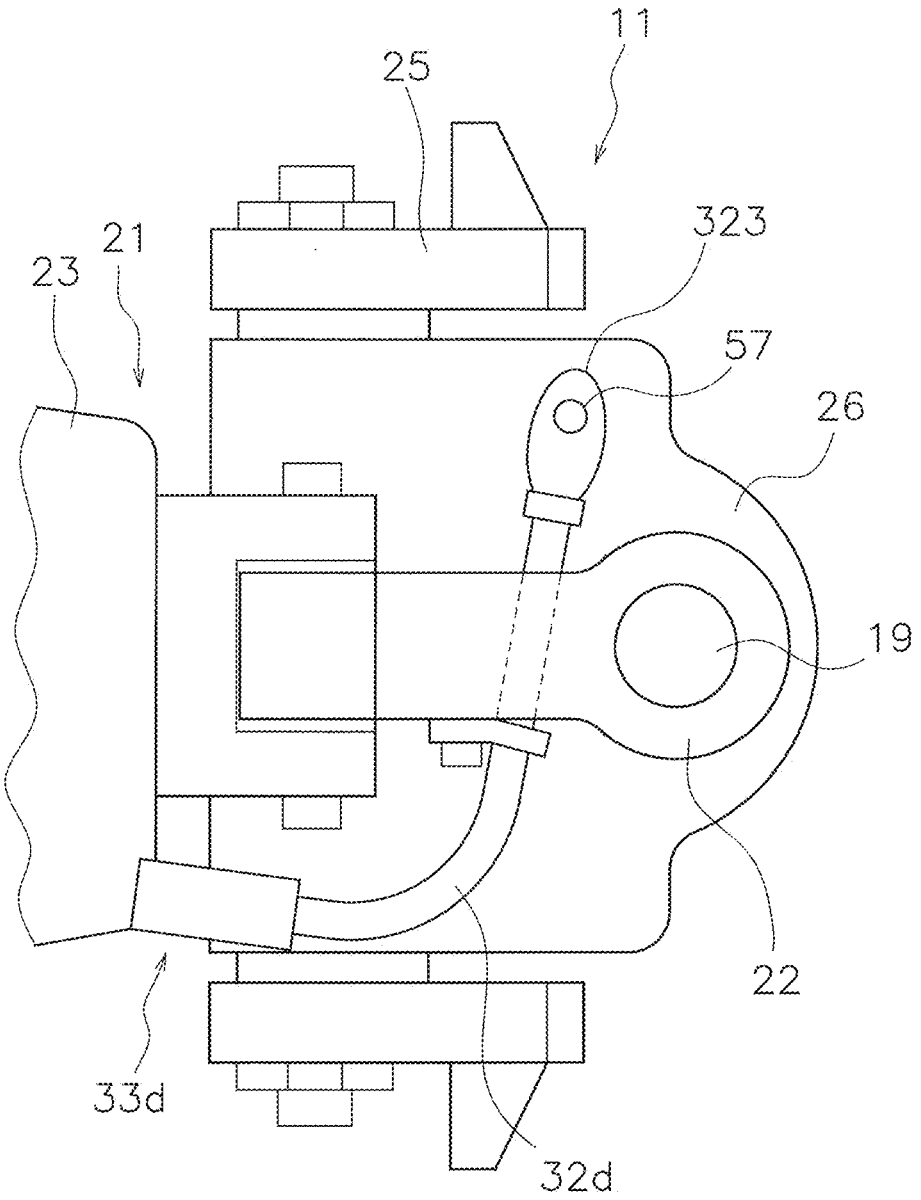
FIG. 9 is a top view of the steering device according to the fourth preferred embodiment of the present invention.

In the preferred embodiments described above, the actuator is fixed to the hull 101 via the bracket 11. However, the actuator may be fixed to the tiller handle 21. FIG. 8 is a side view of a steering device 3*d* according to the fourth preferred embodiment of the present invention. FIG. 9 is a top view of the steering device 3*d* according to the fourth preferred embodiment.

As illustrated in FIG. 8, the actuator 33*d* of the steering device 3*d* according to the fourth preferred embodiment is disposed in the tiller handle 21. More specifically, the actuator 33*d* is disposed in the tiller main body 23. As illustrated in FIG. 8, the controller 44 may be disposed in the tiller handle 21. In addition, the operation switch 43 may be attached to the tiller handle 21.

Figure 10:
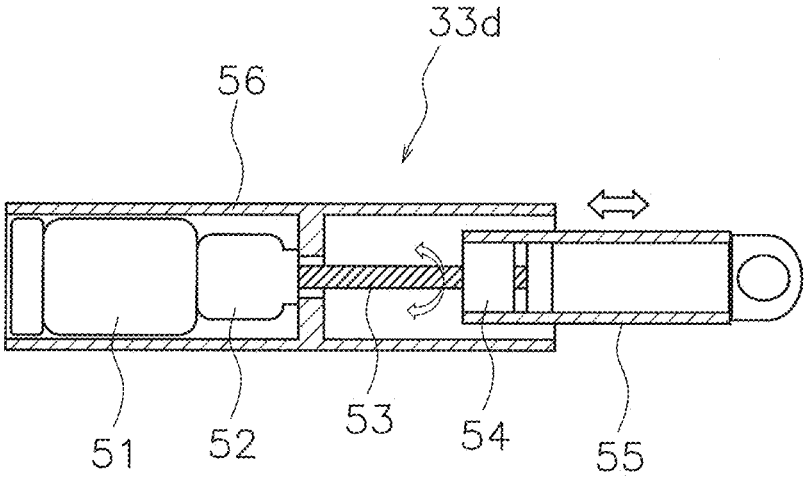
FIG. 10 is a view showing an internal structure of an actuator.

As illustrated in FIGS. 8 and 9, the linkage 32*d* of the steering device 3*d* includes a wire connecting the actuator 33*d* and the hull 101. The actuator 33*d* extends and retracts the linkage 32*d*. FIG. 10 is a view showing the internal structure of the actuator 33*d*. As illustrated in FIG. 10, the actuator 33*d* includes a motor 51, a gear box 52, a screw 53, a movable member 54, a piston rod 55, and a cylinder 56.

The motor 51 is, for example, an electric motor. The screw 53 is, for example, a ball screw. The screw 53 is connected to the motor 51 via a gear (not illustrated) in the gear box 52. The movable member 54 is a nut, for example, and is screwed onto the screw 53. The piston rod 55 is connected to the movable member 54, and moves in the axial direction of the cylinder 56 together with the movable member 54. The motor 51, the gear box 52, the screw 53, the movable member 54, and at least a portion of the piston rod 55 are disposed in the cylinder 56. The movable member 54 and the piston rod 55 are disposed movably with respect to the cylinder 56.

The rotation of the motor 51 is transmitted to the screw 53 through the gear in the gear box 52, and thus the screw 53 is rotated. When the movable member 54 is moved in the axial direction of the cylinder 56 due to the rotation of the screw 53, the piston rod 55 extends and retracts relative to the cylinder 56. The linkage 32*d* is connected to the piston rod 55, and the linkage 32*d* extends and retracts due to the extension and retraction of the piston rod 55.

As illustrated in FIG. 9, the tip end 323 of the linkage 32*d* is connected to the bracket 11. More specifically, the tip end 323 of the linkage 32*d* is connected to the second bracket 26. The second bracket 26 is provided with a connector 57. The tip end 323 of the linkage 32*d* is detachably attached to the connector 57. When the tip end 323 of the linkage 32*d* is attached to the connector 57, the linkage 32*d* is located at the connection position. When the tip end 323 of the linkage 32*d* is removed from the connector 57, the linkage 32*d* is located at the blocking position.

The connector 57 includes, for example, a shaft protruding from the second bracket 26. The tip end 323 of the linkage 32*d* is provided with a hole, and the linkage 32*d* is pivotably and detachably attached to the connector 57 by inserting the shaft into the hole of the tip end 323 of the linkage 32*d*.

However, the tip end 323 of the linkage 32*d* may be connected not only to the second bracket 26 but also to another element such as the first bracket 25. Alternatively, the tip end 323 of the linkage 32*d* may be directly connected to the hull 101 such as a transom of the hull 101.

Figure 11A:
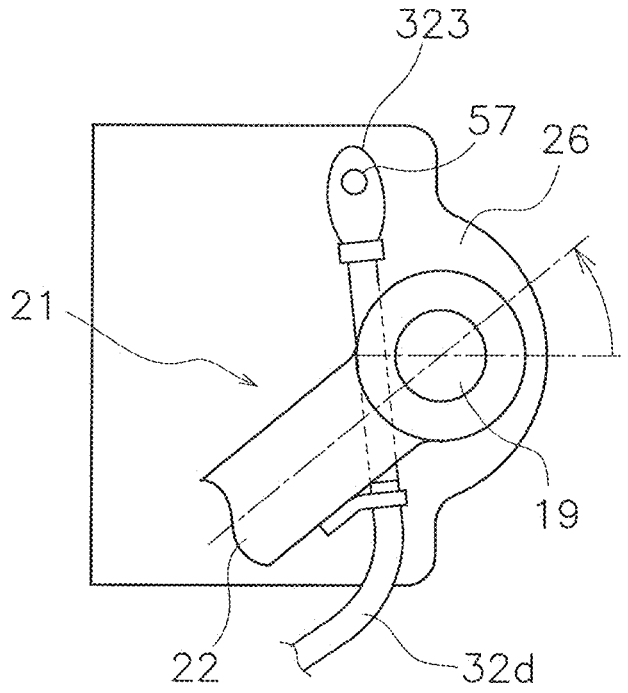
FIGS. 11A and 11B are top views of the steering device according to the fourth preferred embodiment of the present invention.
Figure 11B:
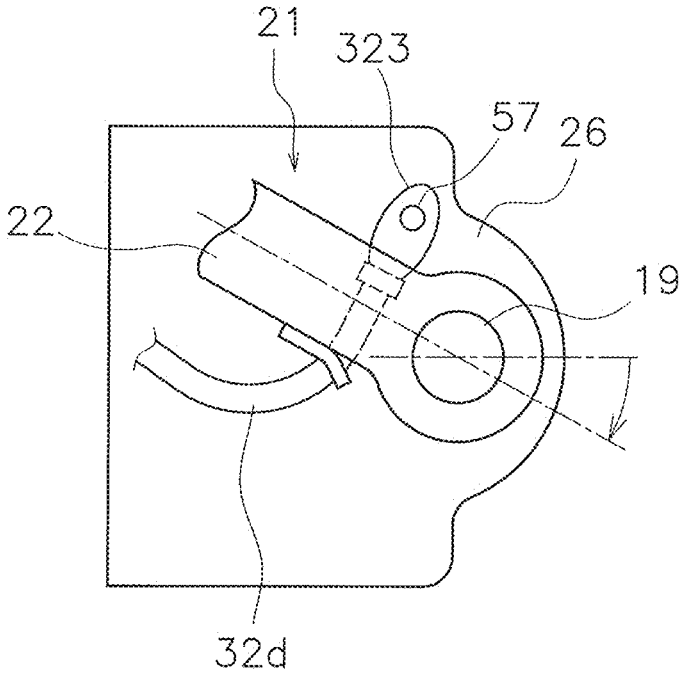

When the linkage 32*d* is extended by the actuator 33*d*, the length of the linkage 32*d* between the actuator 33*d* and the connector 57 is increased. As a result, as illustrated in FIG. 11A, the outboard motor 2 is rotated counterclockwise in a top view together with the tiller handle 21. When the linkage 32*d* is retracted by the actuator 33*d*, the length of the linkage 32*d* between the actuator 33*d* and the connector 57 is shortened. Thus, as illustrated in FIG. 11B, the outboard motor 2 is rotated clockwise in a top view together with the tiller handle 21. Thus, the outboard motor 2 rotates leftward and rightward with the tiller handle 21 as the linkage 32*d* is extended and retracted by the actuator 33*d*.

Figure 12:
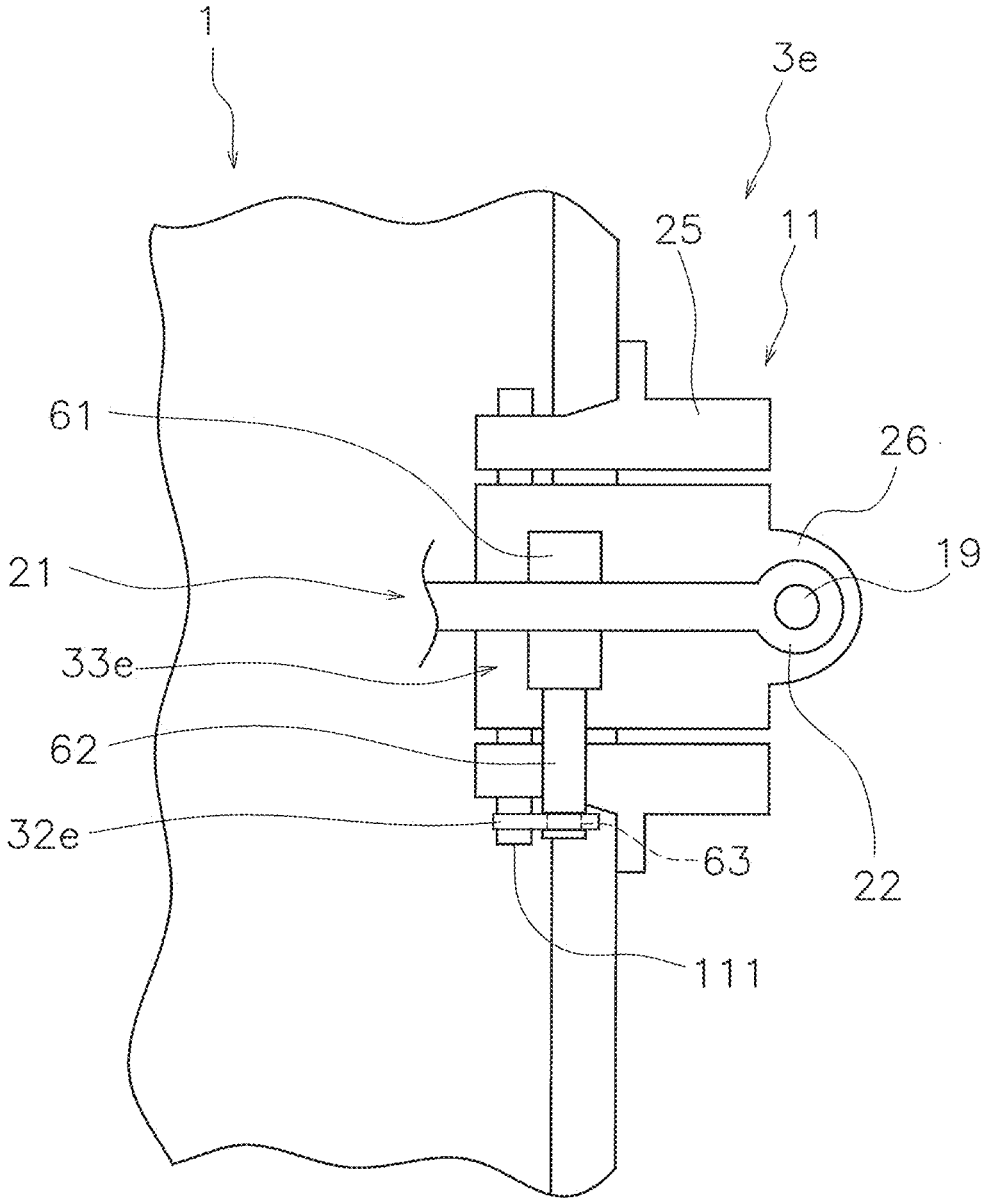
FIG. 12 is a top view of a steering device according to a fifth preferred embodiment of the present invention.

The actuator may be disposed not only in the tiller handle 21 but also outside the tiller handle 21. FIG. 12 is a top view of a steering device 3*e* according to the fifth preferred embodiment of the present invention. In the steering device 3*e* according to the fifth preferred embodiment, the actuator 33*e* is fixed to the arm 22 of the tiller handle 21. The actuator 33*e* includes a cylinder 61 and a piston rod 62 that extends and retracts relative to the cylinder 61. The actuator 33*e* may be an electric actuator, for example, as in the first preferred embodiment described above. Alternatively, the actuator 33*e* may be a hydraulic actuator as in the second preferred embodiment described above.

Figure 13A:
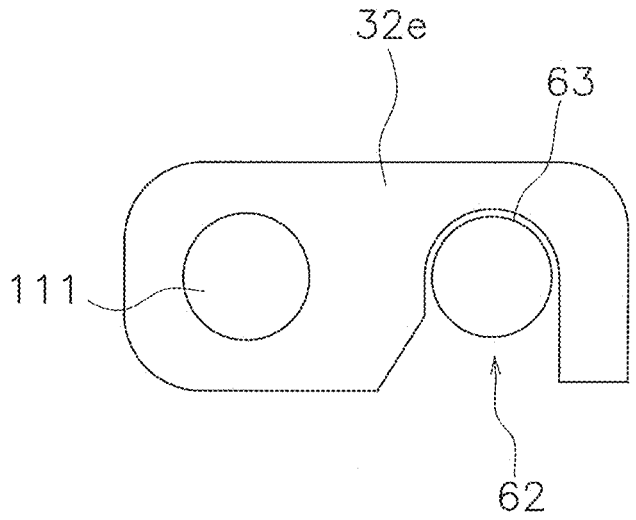
FIGS. 13A and 13B are views showing an example of a linkage.

The linkage 32*e* of the steering device 3*e* connects the piston rod 62 and the bracket 11. The linkage 32*e* includes, for example, a hook-shaped member illustrated in FIGS. 13A and 13B. The linkage 32*e* is rotatably supported at the end of a clamp bolt 111 of the bracket 11. As illustrated in FIG. 12, a circumferentially extending recess 63 is provided on the outer peripheral surface of the tip of the piston rod 62. As illustrated in FIG. 13A, the linkage 32*e* locks in the recess 63 at the connection position. As a result, the piston rod 62 is connected to the bracket 11, and the tiller handle 21 and the outboard motor 2 rotate leftward and rightward in accordance with the extension and retraction of the piston rod 62.

Figure 13B:
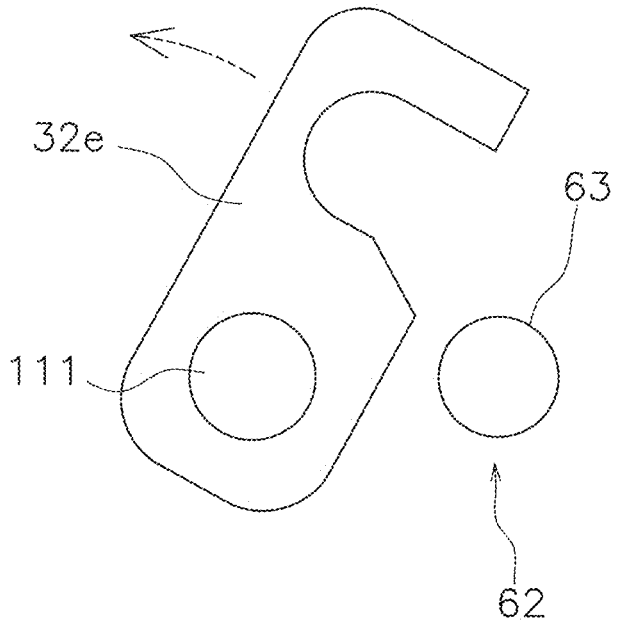

By rotating around the clamp bolt 111, the linkage 32*e* moves from the connection position illustrated in FIG. 13A to the blocking position illustrated in FIG. 13B. When the linkage 32*e* is in the blocking position, the linkage 32*e* is disengaged from the recess 63, such that the connection between the piston rod 62 and the bracket 11 is released. Thus, the operator is able to steer with the tiller handle 21 with a light operating force.

The linkage 32*e* may be rotatably supported by the bracket 11 or another portion of the hull 101, as well as the clamp bolt 111. Alternatively, the linkage 32*e* may be rotatably supported at the tip of the piston rod 62.

Figure 14:
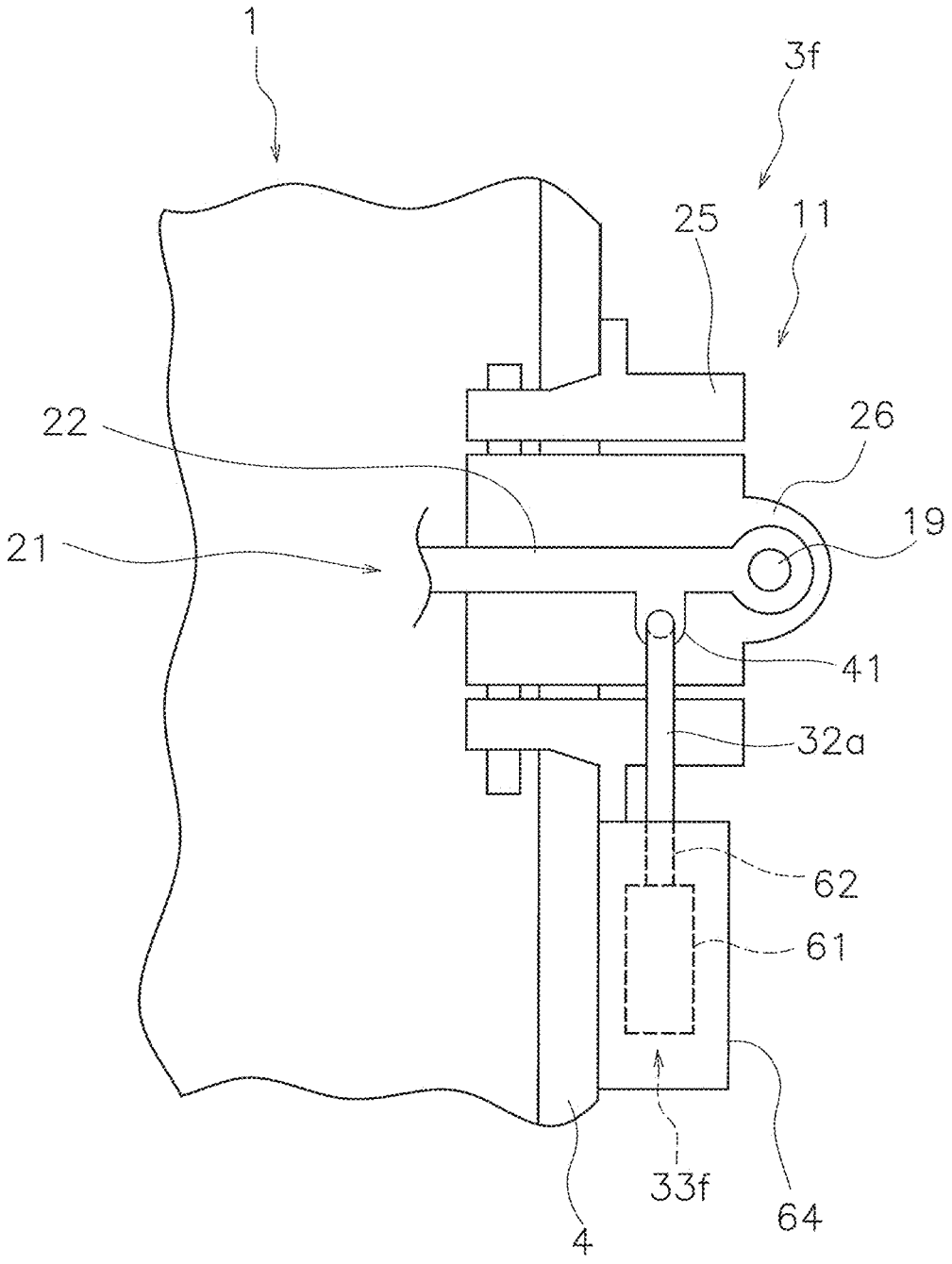
FIG. 14 is a top view of a steering device according to a sixth preferred embodiment of the present invention.

The actuator may be attached directly to the hull 101. FIG. 14 is a top view of a steering device 3*f* according to the sixth preferred embodiment of the present invention. As illustrated in FIG. 14, in the steering device 3*f* according to the sixth preferred embodiment, the actuator 33*f* is attached to the transom 4 of the hull 101. The steering device 3*f* includes a housing 64 attached to the transom 4. The actuator 33*f* is disposed in the housing 34.

Other configurations of the steering device 3*f* according to the sixth preferred embodiment are preferably the same or substantially the same as that of the steering device 3*a* according to the first preferred embodiment. Although not illustrated, a controller that controls the actuator 33*f* may also be disposed in the housing 34.

Preferred embodiments of the present invention have been explained above. However, the present invention is not limited to the above-described preferred embodiments, and a variety of changes can be made without departing from the scope of the present invention.

The process for controlling the steering device 3*a* described in the first preferred embodiment may be performed in the steering devices 3*b* to 3*f* according to the first to sixth preferred embodiments. The process for controlling the steering devices 3*a* to 3*f* may be changed. For example, the steering devices 3*a* to 3*f* may rotate the outboard motor 2 to the left or right according to the operation of the operation switch 43 by the operator.

Figure 15:
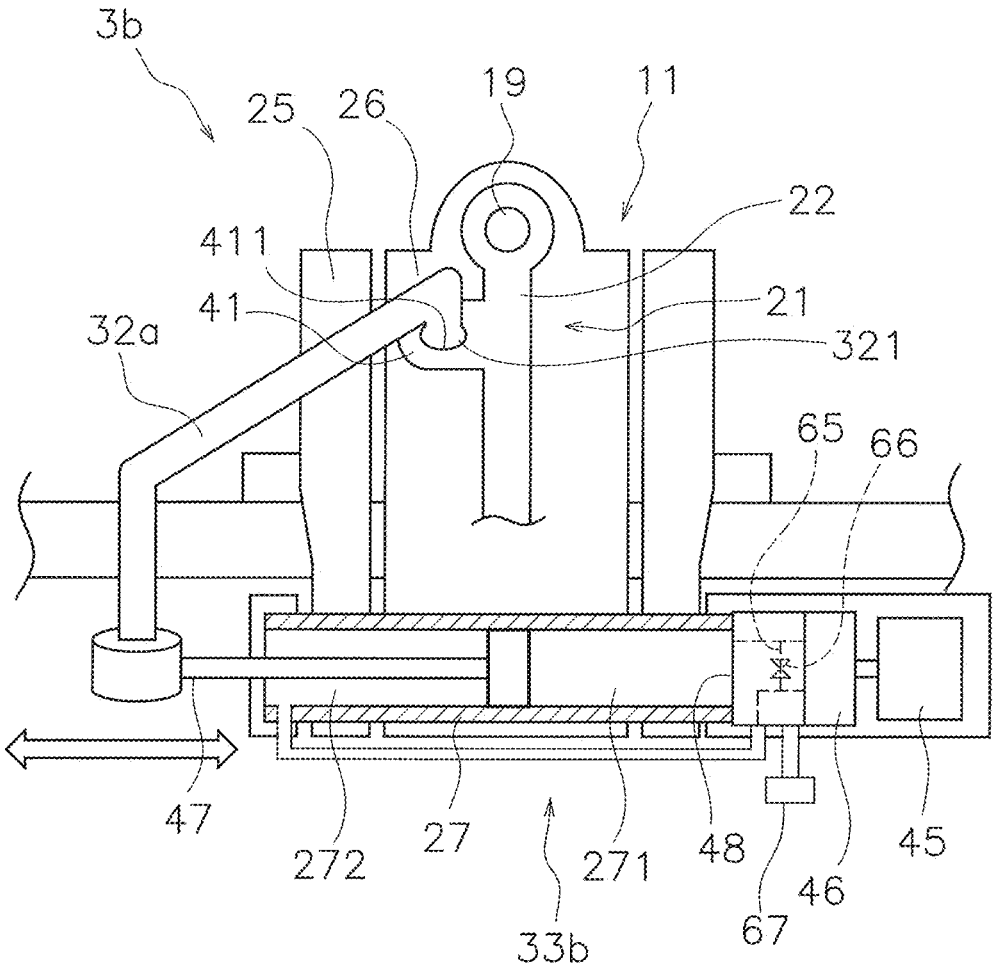
FIG. 15 is a top view of a steering device according to another preferred embodiment of the present invention.

In the hydraulic actuator of the second preferred embodiment, a bypass circuit may be provided in the hydraulic circuit. For example, as illustrated in FIG. 15, the steering device 3*b* may include a bypass circuit 65, a valve body 66, and an open/close lever 67. The bypass circuit 65 causes the first chamber 271 and the second chamber 272 to communicate with each other. The valve body 66 opens and closes the bypass circuit 65 in response to the operation of the open/close lever 67. The open/close lever 67 is switchable between the connection position and the blocking position.

The valve body 66 closes the bypass circuit 65 when the open/close lever 67 is in the connection position. As a result, the piston rod 38 extends and retracts due to the hydraulic pressure from the hydraulic pump 46, so that the outboard motor 2 together with the tiller handle 21 rotates left and right around the steering shaft 19.

When the open/close lever 67 is in the blocking position, the valve body 66 opens the bypass circuit 65. Therefore, when the operator manually steers the outboard motor 2 with the tiller handle 21, switching the valve body 66 to the blocking position reduces the resistance caused by the hydraulic pressure from the actuator 33. Thus, the operator is able to steer with the tiller handle 21 with a light operating force.

The steering device and the outboard motor unit according to the preferred embodiments of the present invention are easily mounted on a small boat, and easily operated manually.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

The invention claimed is:

1. A steering device for an outboard motor rotatably supported by a hull around a steering axis, the steering device comprising:

a tiller handle attached to the outboard motor;

an actuator that rotates the tiller handle about the steering axis; and a linkage movably disposed between a connection position that transmits a driving force from the actuator to the tiller handle, and a blocking position that blocks transmission of the driving force from the actuator to the tiller handle; wherein the tiller handle is attached to the outboard motor such that the tiller handle and the outboard motor rotate integrally around the steering axis; and the actuator provides the driving force to the tiller handle to steer the outboard motor.

2. The steering device according to claim 1, wherein the linkage is detachably connected to the tiller handle.

3. The steering device according to claim 1, wherein the linkage is detachably connected to the actuator.

4. The steering device according to claim 1, further comprising:

a tube that rotatably supports the outboard motor about a tilt axis; and a bracket that attaches the outboard motor to the hull; wherein at least a portion of the actuator is disposed within the tube.

5. The steering device according to claim 4, wherein the actuator includes:

an electric motor;

a ball screw disposed in the tube and connected to the electric motor; and a movable member mounted on the ball screw and that moves in an axial direction of the ball screw due to rotation of the ball screw.

6. The steering device according to claim 4, wherein the actuator includes:

a hydraulic pump; and a piston rod disposed in the tube and that moves due to operation of the hydraulic pump.

7. The steering device according to claim 6, wherein the piston rod divides an inside of the tube into a first chamber and a second chamber; and the piston rod includes:

a bypass circuit that connects the first chamber and the second chamber; and a valve body that opens and closes the bypass circuit in accordance with an operation of the linkage.

8. The steering device according to claim 1, wherein the actuator is disposed in the tiller handle.

9. The steering device according to claim 8, wherein the linkage connects the actuator and the hull; and the actuator extends and retracts the linkage.

10. The steering device according to claim 9, wherein the linkage includes a wire.

11. The steering device according to claim 8, further comprising:

a controller connected to the actuator and disposed within the tiller handle.

12. The steering device according to claim 11, further comprising:

an operation member attached to the tiller handle that sets the controller.

13. The steering device according to claim 1, further comprising:

a housing attached to a transom of the hull; wherein the actuator is disposed within the housing.

14. The steering device according to claim 13, further comprising:

a controller connected to the actuator and disposed within the housing.

15. The steering device according to claim 1, wherein the actuator is connected to the tiller handle at a position between a tip of the tiller handle and the steering shaft.

16. An outboard motor unit comprising:

an outboard motor; and a steering device rotatably supported on a hull about a steering axis, the steering device including:

a tiller handle attached to the outboard motor;

an actuator that rotates the tiller handle about the steering axis; and a linkage movably disposed between a connection position that transmits a driving force from the actuator to the tiller handle, and a blocking position that blocks transmission of the driving force from the actuator to the tiller handle; wherein the tiller handle is attached to the outboard motor such that the tiller handle and the outboard motor rotate integrally around the steering axis; and the actuator provides the driving force to the tiller handle to steer the outboard motor.

* * * * *